US006860514B2

(12) United States Patent
Wentworth et al.

(10) Patent No.: US 6,860,514 B2
(45) Date of Patent: Mar. 1, 2005

(54) DRILL STRING JOINT

(75) Inventors: Steven W. Wentworth, Brookfield, WI (US); Mark D. Randa, Summit, WI (US); Robert F. Crane, Oconomowoc, WI (US)

(73) Assignee: EarthjTool Company, L.L.C., Oconomowoc, WI (US)

( * ) Notice: Subject to any disclaimer, the term of this patent is extended or adjusted under 35 U.S.C. 154(b) by 28 days.

(21) Appl. No.: 10/342,141

(22) Filed: Jan. 14, 2003

(65) Prior Publication Data

US 2003/0166418 A1 Sep. 4, 2003

Related U.S. Application Data

(60) Provisional application No. 60/349,000, filed on Jan. 14, 2002.

(51) Int. Cl.[7] ..... F16I 55/00

(52) U.S. Cl. ..... 285/92; 285/333

(58) Field of Search ..... 285/81, 86, 92, 285/333, 390, 84, 404; 279/86, 100; 464/18; 403/383, 362

(56) References Cited

U.S. PATENT DOCUMENTS

| | | | | | |
|---|---|---|---|---|---|
| 387,475 | A | * | 8/1888 | Whaling | 285/81 X |
| 439,981 | A | * | 11/1890 | Stewart | 285/84 X |
| 451,788 | A | * | 5/1891 | Walp et al. | 279/100 |
| 751,241 | A | * | 2/1904 | Ash | 279/100 |
| 1,102,064 | A | * | 6/1914 | Lowe | 285/390 X |
| 1,238,563 | A | * | 8/1917 | Parker et al. | 279/100 X |
| 2,118,350 | A | * | 5/1938 | Holt | 285/86 X |
| 2,244,124 | A | * | 6/1941 | Shemeley | 285/84 X |
| 2,258,066 | A | * | 10/1941 | Oyen | 285/390 X |
| 3,015,500 | A | * | 1/1962 | Barnett | 285/81 X |
| 3,986,570 | A | | 10/1976 | Stinson et al. | |
| 4,693,498 | A | * | 9/1987 | Baugh et al. | 285/92 X |
| 6,095,259 | A | | 8/2000 | Keyes | |
| 6,148,935 | A | | 11/2000 | Wentworth et al. | |
| 6,161,635 | A | | 12/2000 | Brady | |
| 6,263,983 | B1 | | 7/2001 | Wentworth et al. | |
| 6,422,782 | B1 | | 7/2002 | Wentworth | |
| 2001/0017222 | A1 | | 8/2001 | Wentworth et al. | |

* cited by examiner

*Primary Examiner*—Greg Binda
(74) *Attorney, Agent, or Firm*—Philip G. Meyers

(57) ABSTRACT

A joint connecting a pair of members rotatable about a common axis end to end includes a first member having a threaded end portion and a non-circular exterior surface rearwardly of the threaded end portion, a second member having a threaded socket wherein the threaded end portion of the second member can be engaged, and a non-circular exterior surface, a sleeve having a non-circular profile on an inner surface thereof whereby the sleeve can be slidably mounted on the non-circular exterior profiles of the first and second members when such profiles are brought into alignment by rotation of one member relative to the other in a manner effective to pass torque from one member to the other by means of the non-circular profiles, a first pair of alignable holes in the sleeve and first member to receive a fastener to secure the sleeve to the first member and a hole in the second member penetrating the threaded socket and positioned to receive a fastener to secure the second member to a third member in place of the first member, the third member having a hole in a threaded end portion thereof alignable with the hole in the second member.

6 Claims, 2 Drawing Sheets

DRILL STRING JOINT

This application claims priority of U.S. Provisional Patent Application Ser. No. 60/349,000, filed Jan. 14, 2002.

TECHNICAL FIELD

The invention relates to directional boring and, in particular to an improved joint for connecting tools utilized in directional boring to a drill string.

BACKGROUND OF THE INVENTION

Directional boring apparatus for making holes through soil are well known. The directional borer generally includes a series of drill rods joined end to end to form a drill string. The drill string is pushed or pulled though the soil by means of a powerful hydraulic device such as a hydraulic cylinder or winch. A drill head for boring in soil, rock or both is disposed at the end of the drill string and may include an ejection nozzle for water or other drilling fluid to assist in boring. In other applications, tools such as reamers, pipe bursters, impactors, slitters and pullers are used to slit, burst and replace existing underground pipelines.

Ideally, drill heads and other tools in use in horizontal directional drilling and pipe replacement should be coupled to the drill string and/or other tools in a manner that permits rapid replacement. Tool breakage, changes in strata and similar circumstances often require on site tool changes and replacements. If it is desired to first forward drill a pilot hole and then pull a back reamer through the hole to widen it, it is necessary to uncouple the sonde housing (if used) and drill bit from the drill string in the exit pit and mount the back reamer in place of these components. Consequently, couplings or joints that enable rapid tool changes are very desirable.

Further, the mechanical stresses and abrasive conditions that horizontal drilling and underground pipe replacement tools undergo are severe. Joints between a drill string and tool are subjected to severe torque loadings and longitudinal stresses in these operations. These conditions tend to wear joints rapidly, requiring frequent replacement. Threaded connections are susceptible to thread wear and joint loosening. Failure of a joint in a horizontal drilling or pipe replacement operation can result in a tool stuck in a borehole or pipe, necessitating costly and time consuming excavation to recover the tool or form a bore around the location at which the tool was lost.

SUMMARY OF THE INVENTION

In accordance with the invention, a joint connecting a pair of members rotatable about a common axis end to end includes: (1) a first member having a threaded end portion, a non-circular exterior surface rearwardly of the threaded end portion and a tapered shoulder in between the threaded end portion and the non-circular exterior surface, the tapered shoulder tapering from the non-circular exterior surface of the first member towards the threaded end portion, (2) a second member having a threaded socket wherein the threaded end portion of the second member can be engaged and a non-circular exterior surface, (3) a sleeve having a non-circular profile on an inner surface thereof whereby the sleeve can be slidably mounted on the non-circular exterior profiles of the first and second members when such profiles are brought into alignment by rotation of one member relative to the other in a manner effective to pass torque from one member to the other by means of the non-circular profiles, and (4) a pair of alignable holes in the sleeve and first member for receiving a fastener to secure the sleeve to the first member, whereby an end face of the second member engages the tapered shoulder of the first member when the threaded end portion of the first member is engaged with the threaded socket of the second member with the holes in the sleeve and first member in alignment. In one variation, each of the members is a directional drill head component and the non-circular profiles are octagonal in shape, although other polygonal profiles, such as hexagonal may be employed. In another variation, the non-circular profile may be a splined profile, comprising a series of splines and grooves.

In one aspect, the threaded end portion and the threaded socket have front and rear tapered pilot portions enabling the joint to be further tightened to compensate for thread wear. Thus, when the threaded end portion and the threaded socket are worn during use, the threaded end portion can be tightened further into the threaded socket, causing the end face of the second member to advance along the tapered shoulder of the first member. Each of the non-circular profiles has a matching polygonal shape. In this respect, engagement of the tapered pilot portions provides additional bending moment loading.

BRIEF DESCRIPTION OF THE DRAWINGS

In the accompanying drawings, like numerals represent like elements except where section lines are indicated.

DETAILED DESCRIPTION

While various embodiments of the invention are discussed in detail below, it should be appreciated that the present invention provides many applicable inventive concepts which can be embodied in a wide variety of specific contexts. The specific embodiments illustrated and described herein are merely illustrative of different ways to make and use the invention and do not limit the scope of the invention.

Figure 1:
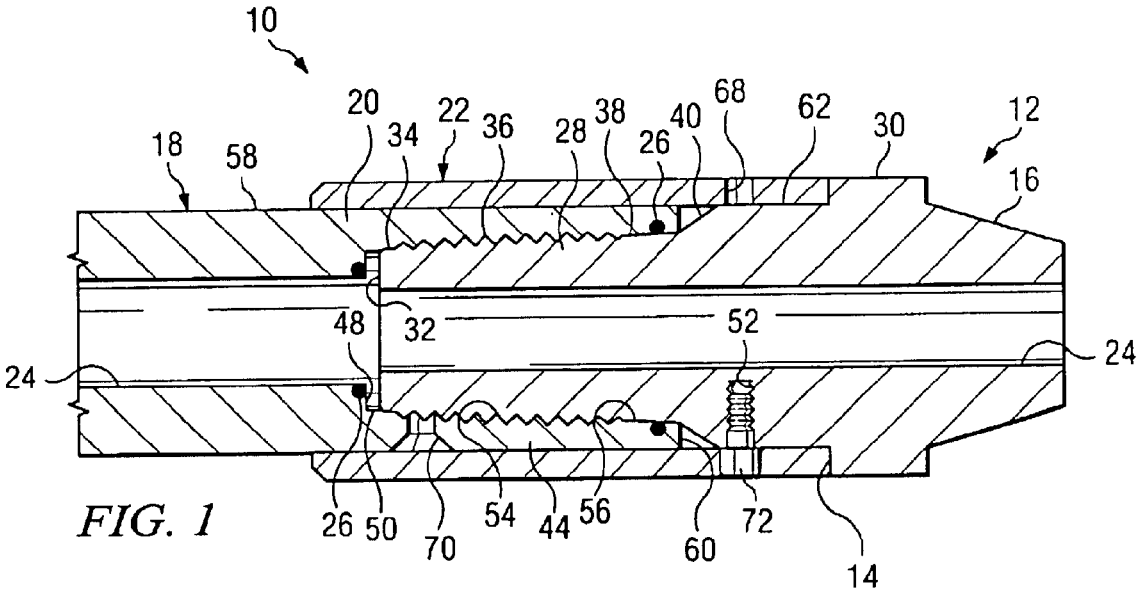
FIG. 1 is a lengthwise sectional view of a first joint according to the invention including a starter rod, adapter and sleeve.
Figure 2:
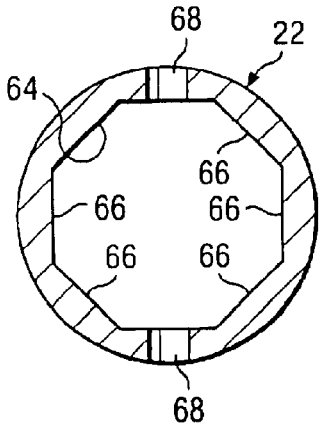
FIG. 2 is a cross section of the sleeve of FIG. 1.

Turning now to FIGS. 1 and 2 a joint 10 according to the invention includes an adaptor 12 with first and second ends 14 and 16, a starter rod 18 with a coupling end 20 and sleeve 22 configured to slide over an adapter 12 and starter rod 18 and transfer torque between the starter rod and adapter upon rotation of the drill string. A fluid passage 24 extends through adapter 12 and starter rod 18, allowing flow of a pressurized medium such as drilling fluid or pressurized air through the drill string. End 16 of adapter 12 may include any convention coupling or joint used to connect underground directional drilling tools and may comprise part of such a tool. One such coupling system is known commercially as Splinelok™ wherein interlocking splines that pass torque from the drill string to a tool is described in Wentworth et al., published U.S. Patent Application Serial No. 2001/0017222, the disclosure of which is incorporated herein by reference for all purposes.

As illustrated, adapter 12 includes a tapered threaded end portion 28 between a central collar 30 and a front wall 32.

End portion 28 includes tapered forward pilot section 34, threads 36, a tapered rear pilot section 38 and a sloped shoulder 40. Coupling end 20 of starter rod 18 includes a threaded socket 44 with an inner end wall 48, a tapered inner pilot section 50, threads 54, an outer tapered pilot section 56 and an end wall 60. Adapter 12 is also provided with threaded bolt hole 52 that extends radially into exterior surface 62 of end portion 28 of adapter 12 and is alignable with a corresponding bolt hole 68 in sleeve 22. Alignable bolt holes 52 and 68 allow adapter 12 to be locked in position relative to sleeve 22 with threaded bolt 72.

As will be appreciated, forward pilot section 34 and rear pilot section 38 of adapter 12 are configured to match inner pilot section 50 and outer pilot section 56 when threaded end portion 28 of adapter 12 is screwed into threaded socket 44 of starter rod 18. A first O-ring 26 may be positioned between front wall 32 of adapter 12 and inner end wall 48 of starter rod 18 and a second O-ring is positioned between rear tapered pilot section 38 of adapter 12 and outer pilot section 56 of starter rod 18. O-rings 26 serve to protect the tapered pilot sections 34, 38, 50, and 56 along with threads 36 and 54 from ingress of abrasive materials that would exacerbate wear of joint 10 during operations.

Referring now to FIGS. 1 and 2 together, adapter 12 includes a non-circular profiled exterior surface 62 between central collar 30 and sloped shoulder 40. Coupling end 20 of starter rod 18 includes an exterior surface 58 with the same or similar non-circular profile as exterior surface 62 of adapter 12. Sleeve 22 includes a corresponding interior non-circular profiled surface 64 adapted to slide over and engage surfaces 58 and 62 to transfer torque between adapter 12 and starter rod 18. As illustrated, the profile of surfaces 62 and 64 is octagonal, however, it is contemplated that other non-circular profiles such as hexagonal, splined and similar profiles may be utilized in constructing a joint in accordance with the invention.

As will be appreciated, when joint 10 is assembled, sleeve 22 is first slid over starter rod 18. Threaded end portion 28 of adapter 12 is then screwed into socket 44 until tightened to the desired level. As adapter 12 is tightened into threaded socket 44, tapered pilot sections 34, 38 of adapter 12 engage tapered pilot portions 50, 56 of socket 44, further securing joint 10 and providing the joint with improved bending load carrying capacity. Additionally, as adapter 12 is tightened into socket 44, end wall 60 of starter rod 18 moves adjacent to sloped shoulder 40, engaging the sloped surface of shoulder 40. Since shoulder 40 is sloped rather than square, end wall 60 may slide over shoulder 40 for a limited distance. The combination of pilot sections 34, 38 and 50, 56 along with sloped shoulder 40 allows threads 36 of adapter 12 and threads 54 of socket 44 to be engaged beyond their initial tightened position to compensate for wear during use. In contrast, a typical threaded connection in this application includes square shoulders or walls that abut upon initial tightening and preclude further tightening as described above. The greater range of thread engagement provided by the invention thus allows joint 10 to be further tightened as threads 36 and 54 wear during operations, thereby extending the usable lifetime of the joint.

After threaded end portion 28 of adapter 12 has been tightened to the desired degree in threaded socket 44, the alignment of exterior surfaces 58 and 62 is checked. If the profiles of the non-circular exterior surfaces 58 and 62 are not aligned sleeve 22 will not slide over adapter 12, consequently, threaded adapter 12 is unscrewed or backed off until the profiles of exterior surfaces 58 and 62 are aligned. Sleeve 22 is then slid along starter rod 18 and over non-circular exterior surface 62 of adapter 12. In the event that the profiles of exterior surfaces 58 and 62 are not aligned when adapter 12 is tightened to the desired level, the degree to which adapter 12 will have to be backed off or loosened to align the profiles depends upon the selected profile. For example, in the case of a octagonal profile, the angle between the centers 66 of each flat surface is 360/8 or 35°. Thus, in case of octagonal profile, the maximum number of degrees that adapter 12 may have to be backed off after tightening to align the octagonal profiles of exterior surfaces 58 and 62 is the rotational difference between successive surfaces, or 35°.

After sleeve 22 has been positioned over adapter 12, a retaining bolt or screw 72 is passed through bolt hole 68 in sleeve 22 and engaged with bolt hole 52 in end 14 of adapter 12, locking the sleeve onto the adapter. Preferably, one or more of alignable holes 52 and 68 and bolt 72 are provided with NPT (National Pipe Thread) threads which provide improved retention and greater shear area than convention straight threads.

If threads 36 and 54 have been sufficiently worn during a previous duty cycle, the combination of pilot sections 34, 50 and 38, 56 along with sloped shoulder 40 allows threaded portion 28 to be tightened in socket 44 beyond its initial position to compensate for the wear. In this case, threaded end portion 28 is rotated or screwed into socket 44 beyond its initial tightened position until the profiles of non-circular exterior surfaces 58 and 62 are re-aligned in a new position relative to each other. The amount of additional rotation will correspond to the number of degrees between centers 66, or if the wear is extreme a multiple thereof. Thus, in the case of joint 10 illustrated in FIG. 1 wherein the profile of exterior surfaces 58 and 62 is octagonal, adapter 12 may be rotated 35° (or multiples thereof) beyond its prior position relative to starter rod 18, to compensate for wear of threads 36 and 54 while simultaneously re-aligning the non circular profiles of exterior surfaces 58 and 62 so that sleeve 22 may be engaged with adapter 12. As will be appreciated,if a conventional square shoulder or end were substituted for sloped shoulder 40, further tightening of the joint to compensate for thread wear would not be possible because such a convention square shoulder would abut end wall 60 of starter rod 18.

Figure 3:
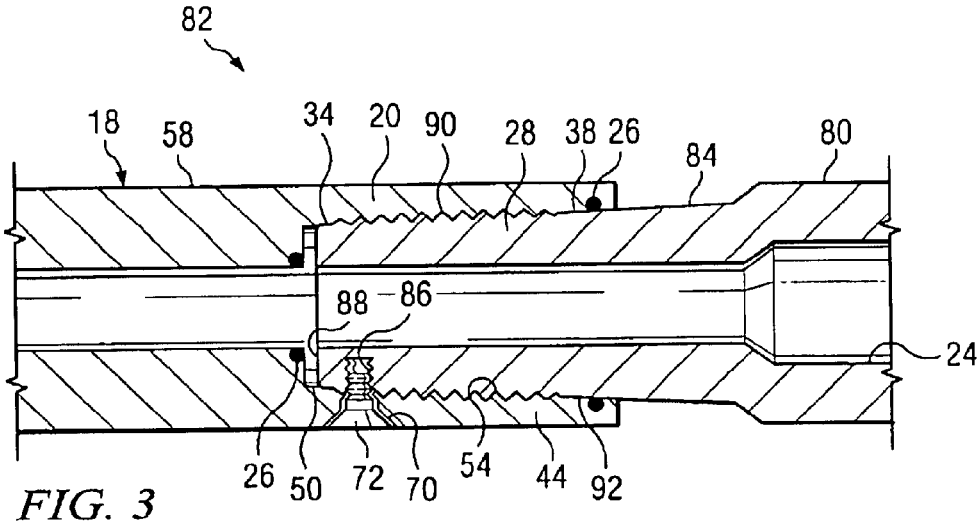
FIG. 3 is a lengthwise sectional view of a second joint in accordance with the invention.

Turning now to FIG. 3, a reciprocal impactor 80 is coupled to starter rod 18, using a joint 82 according to the invention. Since impactor 80 functions by reciprocal movement as opposed to rotation of the drill string, sleeve 22 of joint 10 which serves to transfer torque is omitted. As illustrated, impactor 80 includes a tapered end portion 84 that is substantially similar to threaded end portion 28 of FIG. 1. Tapered end portion 84 includes front tapered pilot section 88, threads 90 and a rear tapered pilot section 92. Tapered end portion 84 further includes a threaded bolt hole 86 that is alignable with bolt hole 70 in socket 44 of starter rod 18. Upon assembly of impactor 80 and starter rod 18, pilot sections 88 and 92 of end portion 84 engage tapered inner and outer pilot sections 50 and 56 of socket 44 in the same manner as described in connection with joint 10 of FIG. 1, providing the same advantages described in connection therewith.

Figure 4:
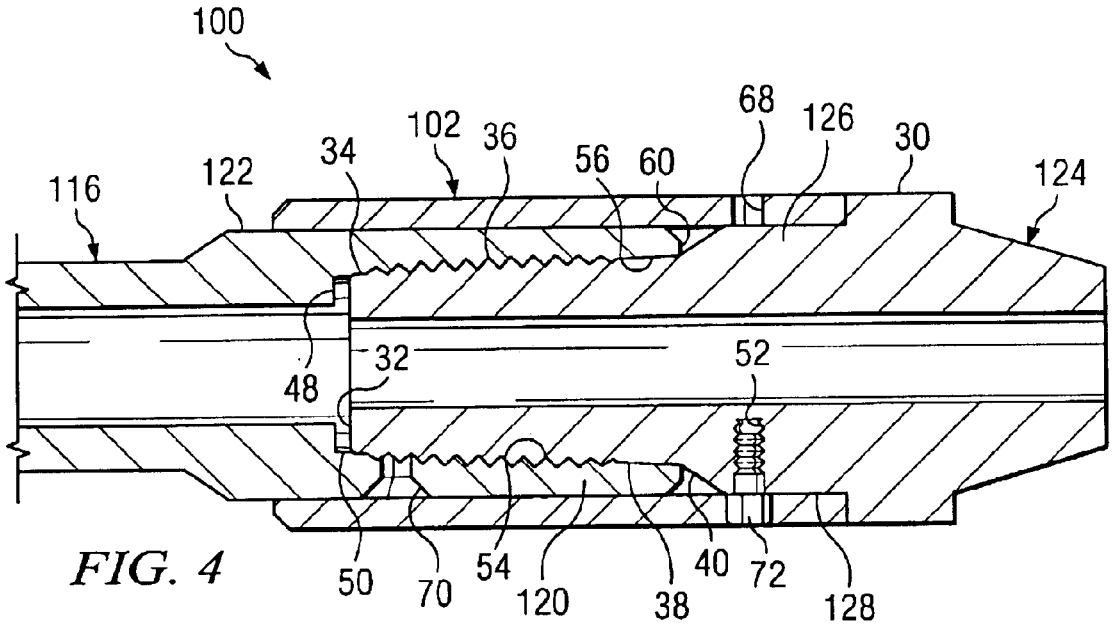
FIG. 4 is a lengthwise section of a third variation of a joint in accordance with the invention.
Figure 5:
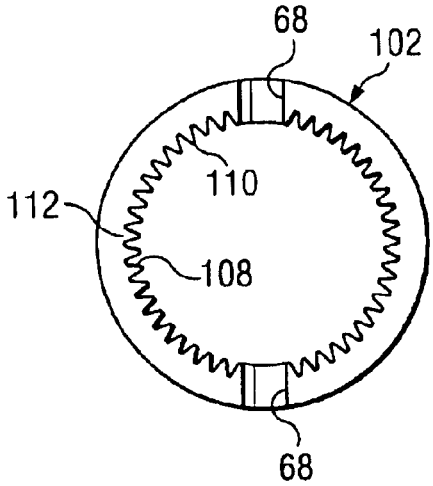
FIG. 5 is cross section of the sleeve of FIG. 4.

Turning now to FIGS. 4 and 5 a joint 100 is substantially identical to the joint 10 of FIG. 1 except that the octagonal mating profile of the sleeve, starter rod and adapter is replaced with a splined profile. Features of joint 100 that are identical to those of joint 10 are identified with the same reference numerals used in FIGS. 1 and 2, and as the functions of such features are identical a detailed description is therefore omitted.

As best shown in FIG. 5, sleeve 102 of joint 100 includes a non-circular interior surface 108 comprising a series of splines 110 and grooves 112. Starter rod 116 includes a threaded tapered socket 120 having an exterior splined surface 122 corresponding to the splined profile of non circular interior surface 108 of sleeve 102. Adapter 124 of joint 100 includes a tapered end portion 126 including a non-circular exterior surface 128 with a splined profile matching that of exterior surface 122 of starter rod 116. In one variation, the profile of interior surface 108 of sleeve 102 and non circular exterior surfaces of starter rod 116 and adapter 124 comprises a spline profile. In this variation, the maximum amount of backing off required to align the splined profiles of exterior surfaces after tightening is 360°/48 or 7.5°. Likewise, starter rod 116 may be tightened to compensate for thread wear beyond its initial tightened position relative to adapter in increments in of 7.5° whereby the splined profile of exterior surfaces 128 and 122 are re-aligned for engagement of sleeve 102. Thus, the use of a splined profile for transferring torque between starter rod 116 and adapter 124 reduces the amount of rotation required to align and re-align the exterior profiles of starter rod 116 and adaptor 124 during installation and re-tightening of joint 100. Additionally the splined profile of interior surface 108 and exterior surfaces 122 and 128 provides greater shear strength for torque transfer between starter rod 116 and adapter 124 than polygonal profiles.

As will be appreciated, the joint of the invention is applicable to a variety of applications wherein tools used in horizontal directional drilling are connected to a drill string. Joints in accordance with the invention are particularly useful in coupling drill bits, sonde housings, reamers, back reamers, starter rods, impactors and similar drilling tools to a drill string or together in a manner that facilitates rapid replacement of such components while simultaneously providing joints and couplings with an increased usable lifetime and enhanced reliability.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

What is claimed is:

1. A joint connecting a pair of members rotatable about a common axis end to end, comprising:

a first member having a threaded end portion, a non-circular exterior surface rearwardly of the threaded end portion, and a tapered shoulder in between the threaded end portion and the non-circular exterior surface, which tapered shoulder tapers from the non-circular exterior surface of the first member towards the threaded end portion;

a second member having a threaded socket wherein the threaded end portion of the first member can be engaged and a non-circular exterior surface;

a sleeve having a non-circular profile on an inner surface thereof whereby the sleeve can be slidably mounted on the non-circular exterior profiles of the first and second members when such profiles are brought into alignment by rotation of one member relative to the other in a manner effective to pass torque from one member to the other by means of the non-circular profiles; and alignable holes in the sleeve and first member for receiving a fastener to secure the sleeve to the first member, whereby an end face of the second member engages the tapered shoulder of the first member when the threaded end portion of the first member is engaged with the threaded socket of the second member with the holes in the sleeve and first member in alignment.

2. The joint of claim 1, wherein the threaded end portion and the threaded socket have front and rear tapered pilot portions, whereby upon wearing of the threaded end portion and the threaded socket during use, the threaded end portion can be tightened further into the threaded socket, causing the end face of the second member to advance along the tapered shoulder of the first member.

3. The joint of claim 1, wherein each of the non-circular profiles has a matching polygonal shape.

4. The joint of claim 3, wherein each of the non-circular profiles has an octagonal shape.

5. The joint of claim 1, wherein each of the non-circular profiles comprises a pattern of lengthwise splines and grooves.

6. The joint of claim 1, wherein each of the members is a directional drill head component.

* * * * *